US010107485B2

(12) United States Patent
Zheng et al.

(10) Patent No.: US 10,107,485 B2
(45) Date of Patent: Oct. 23, 2018

(54) ASSEMBLY STRUCTURE FOR EMBEDDED LIGHT DEVICE

(71) Applicant: XIAMEN ECO LIGHTING CO., LTD., Xiamen, Fujian Province (CN)

(72) Inventors: Xili Zheng, Fujian Province (CN); Jianwei Lao, Fujian Province (CN)

(73) Assignee: XIAMEN ECO LIGHTING CO., LTD. (CN)

( * ) Notice: Subject to any disclaimer, the term of this patent is extended or adjusted under 35 U.S.C. 154(b) by 0 days.

(21) Appl. No.: 15/829,116

(22) Filed: Dec. 1, 2017

(65) Prior Publication Data

US 2018/0245782 A1 Aug. 30, 2018

Related U.S. Application Data

(60) Provisional application No. 62/521,477, filed on Jun. 18, 2017.

(30) Foreign Application Priority Data

Feb. 27, 2017 (CN) ..... 2017 2 0181060

(51) Int. Cl.
*F21S 8/08* (2006.01)
*F21V 21/22* (2006.01)
*F21V 21/04* (2006.01)

(52) U.S. Cl.
CPC ..... *F21V 21/22* (2013.01); *F21V 21/04* (2013.01)

(58) Field of Classification Search
CPC ..... F21V 21/26; F21V 21/30; F21W 2130/10; F16M 11/10; F21S 8/086
USPC ..... 362/418, 420, 423
See application file for complete search history.

(56) References Cited

U.S. PATENT DOCUMENTS

2012/0113640 A1* 5/2012 Markle ..... F21S 8/04 362/249.02
2012/0287625 A1* 11/2012 Macwan ..... F21S 8/026 362/235
2013/0265764 A1* 10/2013 Holman ..... F21V 19/02 362/249.02

* cited by examiner

*Primary Examiner* — Daniel St Cyr
(74) *Attorney, Agent, or Firm* — PROI Intellectual Property US

(57) ABSTRACT

An assembly structure for an embedded light device includes a detachable installation module and an outer ring of the embedded light device. The detachable installation module has sliding grooves extending along with an installation direction and a lock piece having one end abutting against a position recovery element. When the position recovery element is in an initial position, a lock portion at the other end of the lock piece is exposed in the sliding grooves along with a direction perpendicular to a direction of the sliding grooves. When the position recovery element is compressed, the lock piece is compressed along the direction perpendicular to the sliding grooves. The outer ring includes a sliding track for slidably engaging with the sliding grooves. The sliding track includes an engaging piece, the engaging piece including a pressing surface and a locking surface.

20 Claims, 6 Drawing Sheets

ASSEMBLY STRUCTURE FOR EMBEDDED LIGHT DEVICE

CROSS REFERENCE TO RELATED APPLICATIONS

The present application claims priority to Chinese Patent Application CN 201720181060.7 filed on Feb. 27, 2017 and to U.S. provisional application U.S. 62/521,477 filed on Jun. 18, 2017.

TECHNICAL FIELD

The present disclosure relates to light devices and, particularly, to an embedded light device.

BACKGROUND

Nowadays, an embedded light device is assembled via a spring or an elastic piece. However, the embedded light device cannot suit ceilings with different thicknesses. Further, the stability of the assembled light device is relatively weak. When the spring or the elastic piece has been used for a long time or is fatigued, the fixedly assembly is disengaged. In addition, it is very difficult to detach this kind of embedded light device, and a user may be injured by the released elastic piece. Accordingly, in the related art, embedded light devices are relatively weak in stability, reliability and safety, and it is difficult to maintain and detach the light devices.

SUMMARY

The technical problem to be solved by the present invention is to provide an assembly structure for an embedded light device, which can be fixed firmly, can be detached easily, and suit ceilings of different thicknesses.

To solve the above technical problem, the present invention provides an assembly structure for an embedded light device. The assembly structure includes a detachable installation module and a ring structure. The ring structure may be an outer ring used on an/the embedded light device.

The detachable installation module includes sliding grooves extending along with an installation direction and a lock piece. The installation direction is a direction along which the outer ring is coupled with the detachable installation module. One end of the lock piece may abut against a position recovery element. When the position recovery element is in an initial position, a lock portion at the other end of the lock piece may be exposed in the sliding grooves along with a direction perpendicular to a direction of the sliding grooves. When the position recovery element is compressed by applying a force thereon, the lock piece may be compressed along the direction perpendicular to the sliding grooves.

The outer ring may include a sliding track configured for slidably engaging with the sliding grooves. The sliding track may include an engaging piece configured for engaging with the lock piece along the installation direction. The engaging piece may include a pressing surface and a locking surface. When the pressing surface abuts against the lock portion at the other end of the lock piece, the lock portion of the other end of the lock piece may be compressed in response to a force and may move along a detaching direction of the pressing surface, so that the sliding track and the sliding grooves are movable along the installation direction. The detaching direction of the pressing surface is a horizontal direction leaving from the pressing surface. When the pressing surface departs from the lock portion at the other end of the lock piece, the lock portion at the other end of the lock piece may be affected by the position recovery element such that the lock portion locks with the locking surface, and the sliding track and the sliding grooves may be position limited along the installation direction. Accordingly, the sliding track and the sliding grooves may be fixed with each other due to the engagement of the lock portion and the locking surface.

In a preferred embodiment, the detachable installation module may comprise a fixing base and may further comprise a stage. The stage may extend outwardly along a perpendicular direction from a middle of a lateral surface of the fixing base, which is parallel to the sliding track, wherein the perpendicular direction may be a direction perpendicular to the sliding grooves. An end of the stage may extend along its left side and right side horizontally along a direction parallel to the lateral surface, thus forming the sliding grooves at the left side and the right side of the stage.

In a preferred embodiment, the fixing base may have an opening connected with the sliding groove at the lateral surface parallel to the sliding track, and the opening may extend to form a container cavity along the direction perpendicular to the sliding grooves.

In a preferred embodiment, the container cavity may comprise a first cavity and a second cavity connected to each other, wherein an end of the first cavity may be the opening, and a width of the second cavity may be larger than that of the first cavity.

In a preferred embodiment, the position recovery element may be a spring; the position recovery element may be received in the second cavity.

In a preferred embodiment, the lock piece may be arranged in the first cavity, and an end of the lock piece may extend to the second cavity to abut against the spring. The end of the lock piece extending to the second cavity may have a position limiting wall; when the spring is in an original state, i.e. when the spring is not compressed or stretched, the position limiting wall may abut against an outer wall where the second cavity connects the first cavity, thus limiting a position of the position limiting wall along a direction away from the second cavity.

In a preferred embodiment, the lock piece may comprise a leading skew surface at the other end of the lock piece, and an end of the leading skew surface may be connected to the lock piece via a horizontal surface.

In a preferred embodiment, the engaging piece may comprise tooth-like structures (or "teeth" for short) arranged continuously along the detaching direction; the pressing surface may be a skew surface with teeth, and the locking surface may be a perpendicular surface with teeth; the skew surface of the teeth may be placed opposite to the leading skew surface, and the skew surface of the teeth may be coupled with the leading skew surface The locking surface may abut against a perpendicular surface of a previous tooth, the previous tooth being a tooth that is previously engaged with the locking surface; when the leading skew surface moves downwards, the pressing force between two skew surfaces may push the lock piece to move along the direction towards the second cavity; when the lock piece moves so that the two skew surfaces are separated from each other, a position recovery force of the spring may drive the lock piece to return to its original position, so that the leading skew surface may abut against the skew surface of next tooth, the next tooth being a tooth that is to be engaged with the locking surface next, that is, at a following step.

In a preferred embodiment, the buffer elastic clip may be arranged between a surface ring of the outer ring and a bottom of the fixing base, when the detachable installation module is moved downwards along the installation direction, the buffer elastic clip is pressed and generates an elastic deformation.

In a preferred embodiment, the buffer elastic piece may be V-shaped, comprising two free ends; one free end may be plugged to a socket at the bottom of the fixing base, while the other free end may abut against the outer ring. Each one of the two free ends of the buffer elastic clip forms an elastic stage extending outwardly, wherein the two elastic stages may extend in opposite directions. One end of the elastic stage may be connected to the buffer elastic clip, and the other end may be bent to form a free end.

In comparison with the related art, the present invention exhibits at least the following advantages:

The present invention relates to an assembly structure for an embedded light device. The assembly structure includes a lock piece, a pressing surface, and a locking surface. The pressing surface and the locking surface are configured for engaging with the lock piece. During installation, when the lock piece abuts against the pressing surface, a pressing force makes the lock piece to shrink. When an external force is applied to push the lock piece towards inside of the detachable installation module along a direction perpendicular to the sliding grooves, the lock portion of the lock piece is completely disengaged from the engaging piece, and no position limiting element exists on the lock piece matching surface parallel to the sliding track. Accordingly, the detachable installation module is freely movable along the installation direction. When the pressing force between the lock piece and the pressing surface disappears, the position recovery element drives the lock piece to return to its initial position where the lock piece is engaged with the locking surface, thus fixing the detachable installation module in the current position. Thus, the assembling of the detachable installation module and the outer ring can be done without other tools. Furthermore, the detachable installation module can be adjusted to couple with locking surfaces of different heights. Therefore, the assembly structure can be used in ceilings of different thicknesses. The assembly structure has a simple structure.

DETAILED DESCRIPTION

Figure 1:
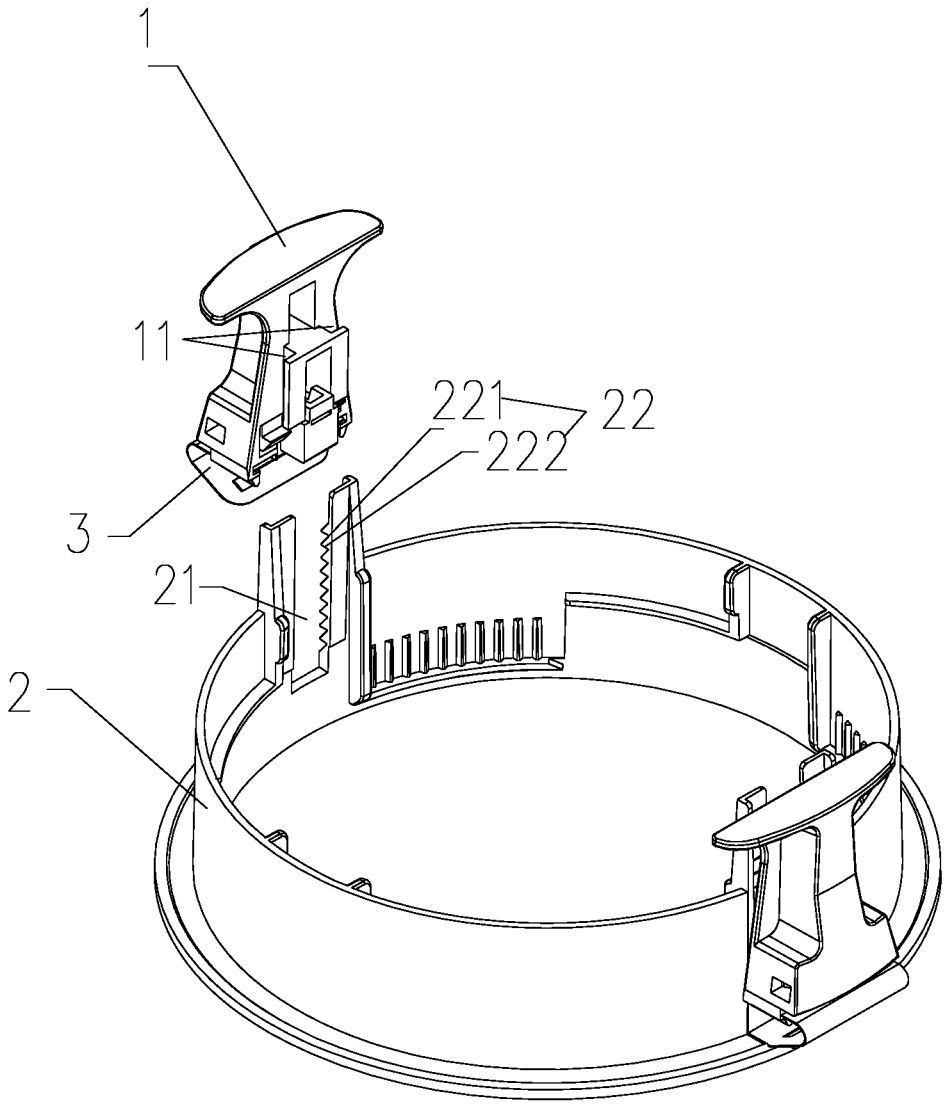
FIG. 1 is an exploded perspective view of one embodiment of the present invention.
Figure 2:
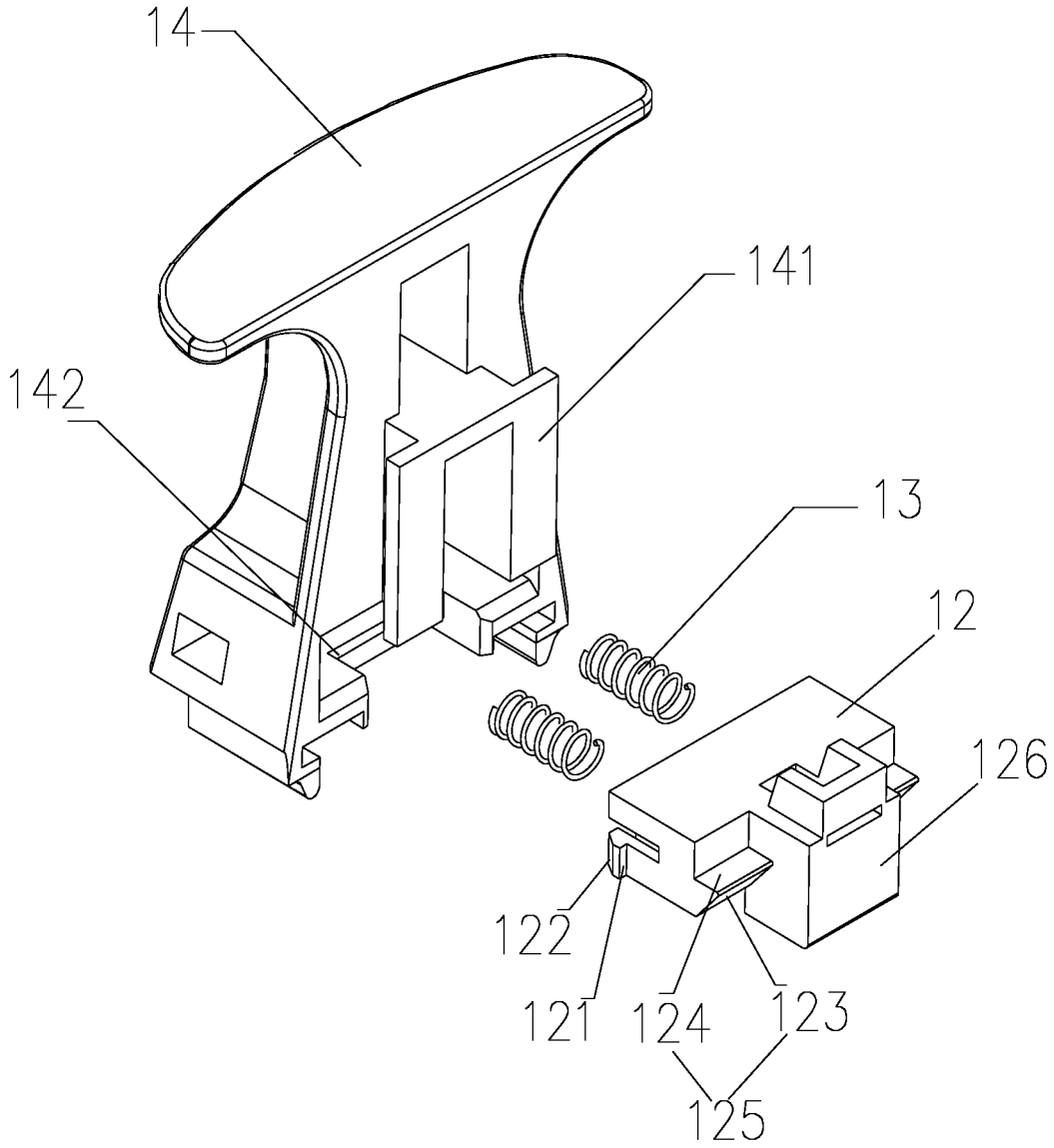
FIG. 2 is an exploded perspective view of a detachable installation module according to one embodiment of the present invention.
Figure 3:
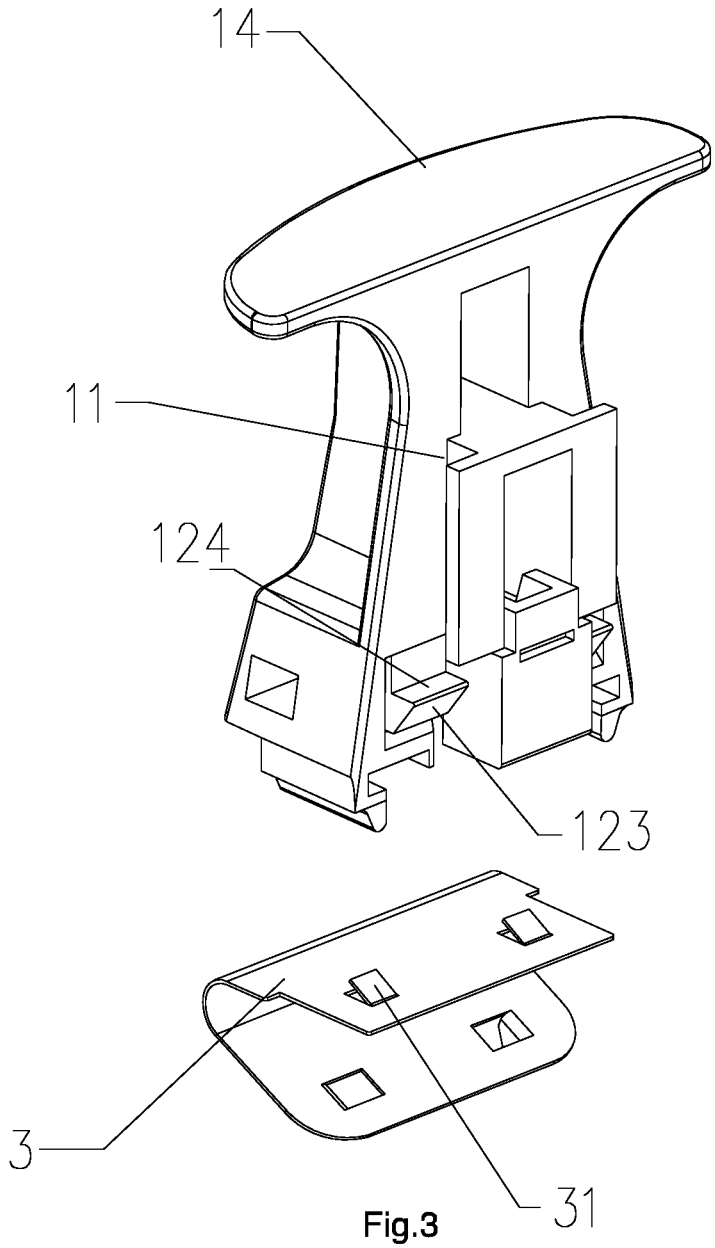
FIG. 3 is an exploded perspective view of the detachable installation module and the buffer elastic clip according to one embodiment of the present invention.
Figure 4:
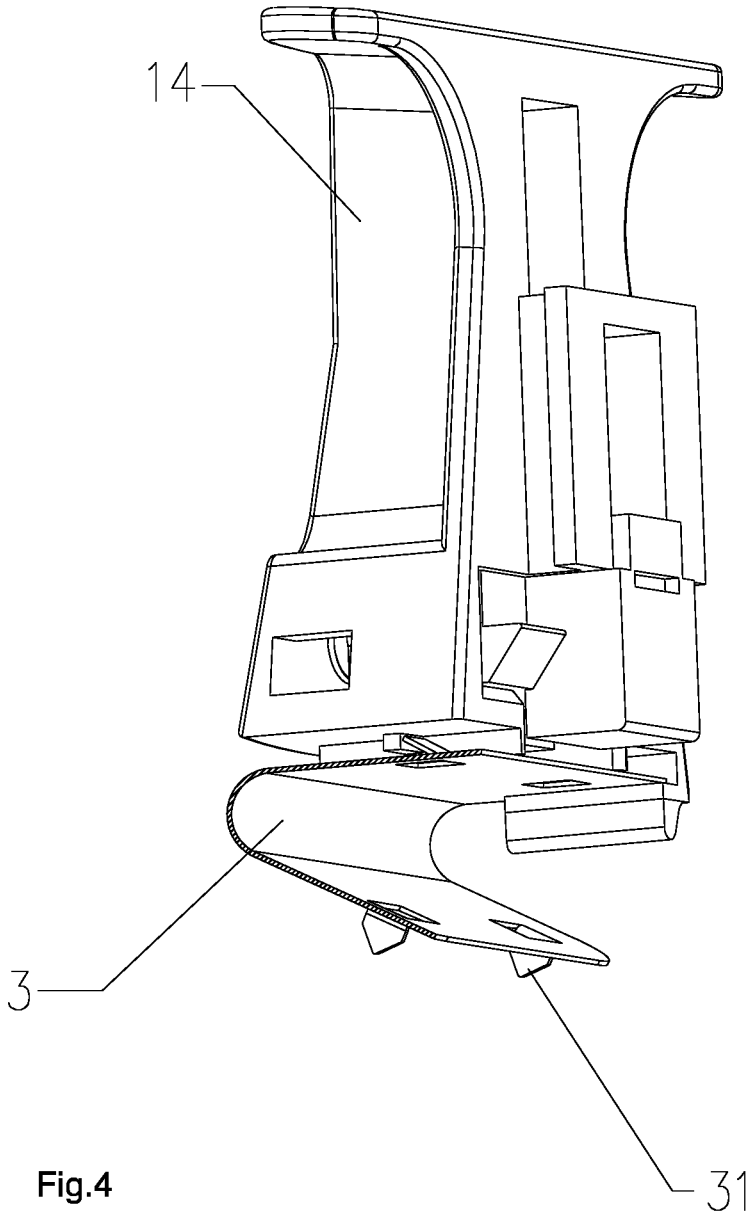
FIG. 4 is an assembling view of the detachable installation module and the buffer elastic clip according to one embodiment of the present invention.
Figure 5:
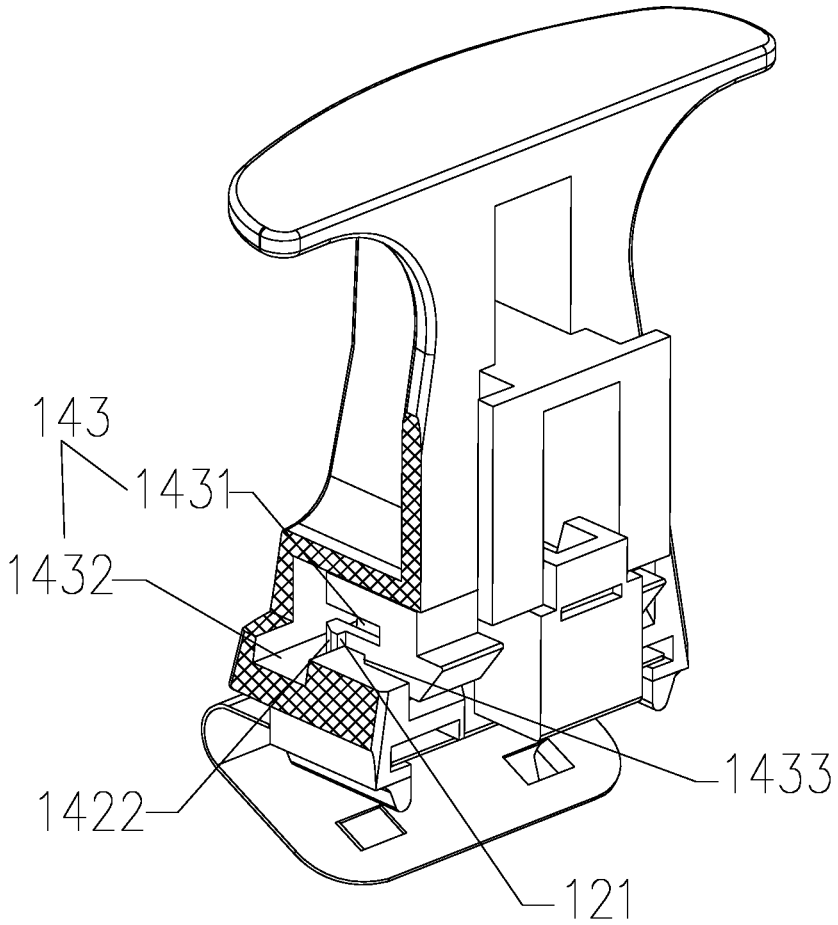
FIG. 5 is a partially cut-away view of the detachable installation module according to one embodiment of the present invention.
Figure 6:
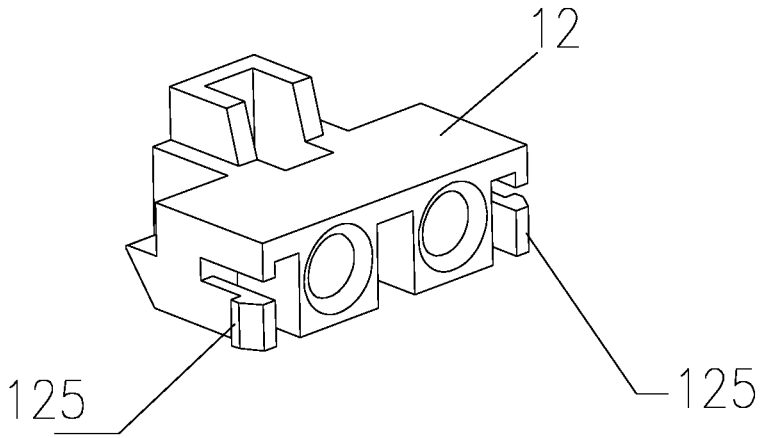
FIG. 6 is a perspective view of the lock piece according to one embodiment of the present invention.

FIG. 1 to FIG. 5 illustrate an embodiment according to the present invention. The embodiment includes an assembly structure for an embedded light device for quickly installing the embedded light device. The assembly device includes a detachable installation module 1 and an outer ring 2 of the embedded light device.

The detachable installation module 1 has a sliding groove 11 along with an installation direction, and a lock piece 12. One end of the lock piece 12 abuts with a spring piece 13. When the spring piece 13 is in an initial position, a lock portion 125 at the other end of the lock piece 12 is exposed in the sliding groove 11 along with a direction perpendicular to the direction of the sliding groove 11. When the spring piece 13 is shrunk by applying a force thereon, the lock piece is collected within the detachable installation module 1 along the direction perpendicular to the sliding groove 11.

The outer ring 2 includes a sliding track 21 corresponding to the sliding groove. The sliding track 21 has an engaging piece 22 along the installation direction. The engaging piece 22 includes a pressing surface 221 and a locking surface 222. When the pressing piece 221 abuts with the lock portion at the other end of the lock piece 12, the lock portion 125 of the other end of the lock piece 12 is shrunk in response to a force and moves along with detaching direction of the pressing surface 221 so that the sliding track 21 and the sliding groove 11 are movable along the installation direction. The pressing surface 221 moves and departures from the lock portion 125 at the other end of the lock piece 12. The lock portion at the other end of the lock piece 12 is affected by the spring piece 13 to lock with the locking surface 222. The sliding track 21 and the sliding groove 11 are position limited along the installation direction.

Therefore, during installation, when the installation module 1 is pushed downwardly along the direction of the sliding groove 11, the pressing force between the lock piece 12 and the pressing surface 221 makes the lock piece 12 shrunk. When the lock piece 12 is pushed along the direction inside the installation module 1 perpendicular to the sliding groove 11, the lock portion of the lock piece 12 is completely detached from the engaging piece 22 and no limiting piece exists on the lock piece matching surface parallel to the sliding track 21. Therefore, the installation module 1 is able to move along the installation direction freely. When the pressing force between the lock piece 12 and the pressing surface 221 disappears, the spring piece 13 causes the lock piece 12 to move back and locked with the lock surface 222 to fix the installation module 1 at current position. By such design, a user does not need a tool to fix the installation module 1 to the outer ring 2. In addition, by adjusting the installation module 1 to lock with lock surface 222 with different height level, such structure may be adapted to ceilings with different thickness. The structure is simple and reliable.

A more detailed description of the embodiment is provided as follow.

The installation module 1 includes a fixing base 14, which lateral middle portion extends outwardly a stage 141 along a perpendicular direction parallel to the sliding track 21. The end of the stage 141 extends along left and right side along a direction parallel to the lateral portion so that to form a sliding groove 11 at the left side and the right side of the stage 141.

To achieve movement of the lock piece, the fixing base 14 has an opening 142 connected with the sliding groove at the lateral side parallel to the sliding track 21. The opening 142 extends and forms a container cavity 143 along the direction perpendicular to the sliding groove 11.

The containing cavity 143 includes a first cavity 1431 and a second cavity 1432 connected to each other. The end of the first cavity 1431 is the opening 142. The width of the second cavity 1432 is larger than the first cavity 1431. The inner lateral wall of the first cavity 1431 has a skew surface 1433 tilt along the moving direction of the lock piece 12. The lock piece 12 is a rubber band placed in the first cavity 1431 and has one end extending to the second cavity 1432 to abut with the spring piece 13. The end of the lock piece 12 extended to the second cavity 1432 has a position limiting wall 121 and a skew wall 122. When the lock piece 12 is installed, the lock piece 12 moves from the first cavity 1431 to the second cavity 1432 so that the skew surface 1433 abuts with the skew wall 122 and the generated pressing force squeezes the rubber band inwardly to move through the first cavity 1433 to enter the second cavity 1432. When this happens, the pressing force between the skew surface 1433 and the skew wall 122 disappears, the rubber bands extend outwardly so that the position limiting wall 121 abuts against an outer wall where the second cavity 1432 connects the first cavity 1431, thus limiting a position of the position limiting wall 121 along a direction away from the second cavity 1432.

The position recovery element may be a spring, which can be placed in the second cavity 1432.

To engage the lock piece 12 with the engaging piece 22, the other end of the lock piece 12 has a leading skew surface 123. The end of the leading skew surface 123 is connected to the lock piece 12 through a horizontal surface 124. The leading skew surface 123 and the horizontal surface 124 form the lock portion 125. The engaging piece 22 includes the teeth arranged continuously along the detaching direction. The engaging piece 22 is arranged at two sides of the sliding track 11. The lock piece 12 corresponds to the lock portion 125. The pressing surface 221 is a skew surface with teeth. The locking surface 222 is a perpendicular surface with teeth to prevent the lock piece 12 to slide out from the top opening of the sliding track 11.

The engaging procedure between the lock piece 12 and the engaging piece 22 is explained as follows. The skew surface of the teeth is placed opposite to the skew surface 123 and matches to each other. The locking surface 222 abuts to a perpendicular surface of a previous tooth. When the leading skew surface 123 moves downwardly, the pressing force between two skew surfaces pushes the lock piece 12 to move along the direction to be close to the second cavity 1432.

When the lock piece 12 moves so that the two skew surfaces separate, the pressing force disappears. The position recovery force of the spring pushes the lock piece to go back to original position so that the leading skew surface 123 abuts to the skew surface of next tooth. With such design, the lock piece 12 is able to be assembled quickly, further its installation height can be adjusted.

The other end of the lock piece 12 has a pressing portion 126. By pressing the pressing portion 126, the lock piece 12 is shrunk along the direction perpendicular to the sliding groove 11. In a variation similar to above embodiment to further enhance user sensitivity during installation, a buffer elastic clip 3 is placed between the outer ring 1 and the bottom of the fixing base 14. When the installation module 1 moves downwardly along the installation direction, the buffer elastic clip 3 has elastic form change and abuts to a ceiling. With such design, a force opposite to the installation direction is obtained during installation so that to form a buffering force when the installation module contacts with the ceiling to more closely fix a down light to the ceiling.

In this embodiment, the buffer elastic clip 3 has a V shape, with its free end plugging to a socket at the bottom of the fixing base 14. The other free end of the buffer elastic clip 3 abuts to the outer ring 1. The two free ends of the buffer elastic clip 3 form an outwardly directed elastic stage 31, wherein the two free ends may extend in opposite directions. One end of the elastic stage 31 is connected to the buffer elastic clip 3 and the other end is bent to form a free end to further enhance elastic characteristic of the buffer elastic clip 3.

Other variations may be made persons skilled in the art by the teaching of the embodiments and description above and should be regarded being covered by the invention.

What is to be claimed is:

1. An assembly structure for an embedded light device, characterized in that:

the assembly structure comprises a detachable installation module and an outer ring of the embedded light device;

the detachable installation module has sliding grooves extending along with an installation direction and a lock piece; one end of the lock piece abuts against a position recovery element, when the position recovery element is in an initial position, a lock portion at the other end of the lock piece is exposed in the sliding grooves along with a direction perpendicular to a direction of the sliding grooves; when the position recovery element is compressed by applying a force thereon, the lock piece is compressed along the direction perpendicular to the sliding grooves;

the outer ring comprises a sliding track configured for slidably engaging with the sliding grooves; the sliding track comprises an engaging piece along the installation direction, the engaging piece comprises a pressing surface and a locking surface;

when the pressing surface abuts against the lock portion at the other end of the lock piece, the lock portion of the other end of the lock piece is compressed in response to a force and moves along with a detaching direction of the pressing surface, so that the sliding track and the sliding grooves are movable along the installation direction;

when the pressing surface moves and departures from the lock portion at the other end of the lock piece, the lock portion at the other end of the lock piece is affected by the position recovery element such that the lock portion locks with the locking surface, and the sliding track and the sliding grooves are position limited along the installation direction.

2. The assembly structure according to claim 1, wherein the detachable installation module comprises a fixing base and a stage, the stage extending outwardly along a direction perpendicular to the sliding grooves and from a middle of a lateral surface of the fixing base, which is parallel to the sliding track; an end of the stage extends along a left side and a right side horizontally along a direction parallel to the lateral surface, thus forming the sliding grooves at the left side and the right side of the stage.

3. The assembly structure according to claim 2, wherein the fixing base has an opening connected with the sliding groove at the lateral surface parallel to the sliding track, and the opening extends and forms a container cavity along the direction perpendicular to the sliding grooves.

4. The assembly structure according to claim 3, wherein the container cavity comprising a first cavity and a second cavity connected to each other, an end of the first cavity is the opening, and a width of the second cavity is larger than that of the first cavity.

5. The assembly structure according to claim 4, wherein the position recovery element is a spring, and is received in the second cavity.

6. The assembly structure according to claim 5, wherein the lock piece is arranged in the first cavity, and an end of the lock piece extends to the second cavity to abut against the spring; the end of the lock piece extending to the second cavity has a position limiting wall; when the spring is in an original state, the position limiting wall abuts against an outer wall where the second cavity connects the first cavity, thus limiting a position of the position limiting wall along a direction away from the second cavity.

7. The assembly structure according to claim 6, further comprising a buffer elastic clip, wherein the buffer elastic clip is arranged between a surface ring of the outer ring and a bottom of the fixing base, when the detachable installation module is moved downwards along the installation direction, the buffer elastic clip is pressed and generates an elastic deformation.

8. The assembly structure according to claim 2, further comprising a buffer elastic clip, wherein the buffer elastic clip is arranged between a surface ring of the outer ring and a bottom of the fixing base, when the detachable installation module is moved downwards along the installation direction, the buffer elastic clip is pressed and generates an elastic deformation.

9. The assembly structure according to claim 8, wherein the buffer elastic piece is V-shaped, the buffer elastic piece comprises two free ends, one free end is plugged to a socket at the bottom of the fixing base, the other free end abuts against the outer ring; each one of two free ends of the buffer elastic clip form an elastic stage extending outwardly, the two free ends extending in opposite directions; one end of the elastic stage is connected to the buffer elastic clip, and the other end is bent to form a free end.

10. The assembly structure according to claim 3, further comprising a buffer elastic clip, wherein the buffer elastic clip is arranged between a surface ring of the outer ring and a bottom of the fixing base, when the detachable installation module is moved downwards along the installation direction, the buffer elastic clip is pressed and generates an elastic deformation.

11. The assembly structure according to claim 10, wherein the buffer elastic piece is V-shaped, the buffer elastic piece comprises two free ends, one free end is plugged to a socket at the bottom of the fixing base, the other free end abuts against the outer ring; each one of two free ends of the buffer elastic clip form an elastic stage extending outwardly, the two free ends extending in opposite directions; one end of the elastic stage is connected to the buffer elastic clip, and the other end is bent to form a free end.

12. The assembly structure according to claim 4, further comprising a buffer elastic clip, wherein the buffer elastic clip is arranged between a surface ring of the outer ring and a bottom of the fixing base, when the detachable installation module is moved downwards along the installation direction, the buffer elastic clip is pressed and generates an elastic deformation.

13. The assembly structure according to claim 12, wherein the buffer elastic piece is V-shaped, the buffer elastic piece comprises two free ends, one free end is plugged to a socket at the bottom of the fixing base, the other free end abuts against the outer ring; each one of two free ends of the buffer elastic clip form an elastic stage extending outwardly, the two free ends extending in opposite directions; one end of the elastic stage is connected to the buffer elastic clip, and the other end is bent to form a free end.

14. The assembly structure according to claim 5, further comprising a buffer elastic clip, wherein the buffer elastic clip is arranged between a surface ring of the outer ring and a bottom of the fixing base, when the detachable installation module is moved downwards along the installation direction, the buffer elastic clip is pressed and generates an elastic deformation.

15. The assembly structure according to claim 14, wherein the buffer elastic piece is V-shaped, the buffer elastic piece comprises two free ends, one free end is plugged to a socket at the bottom of the fixing base, the other free end abuts against the outer ring; each one of two free ends of the buffer elastic clip form an elastic stage extending outwardly, the two free ends extending in opposite directions; one end of the elastic stage is connected to the buffer elastic clip, and the other end is bent to form a free end.

16. The assembly structure according to claim 1, wherein the lock piece comprises a leading skew surface at the other end thereof, an end of the leading skew surface is connected to the lock piece to the lock piece via a horizontal surface, and the leading skew surface and the horizontal surface form the lock portion.

17. The assembly structure according to claim 16, wherein the engaging piece comprises the teeth arranged continuously along the detaching direction, the pressing surface is a skew surface with teeth, the locking surface is a perpendicular surface with teeth;

the skew surface of the teeth is placed opposite to the leading skew surface, and the skew surface of the teeth is coupled with the leading skew surface, the locking surface abuts against a perpendicular surface of a previous tooth;

when the leading skew surface moves downwards, the pressing force between two skew surfaces pushes the lock piece to move along the direction to be close to the second cavity;

when the lock piece moves so that the two skew surfaces are separated from each other, a position recovery force of the spring drives the lock piece to return to an original position, so that the leading skew surface abuts against the skew surface of next tooth.

18. The assembly structure according to claim 17, further comprising a buffer elastic clip, wherein the buffer elastic clip is arranged between a surface ring of the outer ring and a bottom of the fixing base, when the detachable installation module is moved downwards along the installation direction, the buffer elastic clip is pressed and generates an elastic deformation.

19. The assembly structure according to claim 16, further comprising a buffer elastic clip, wherein the buffer elastic clip is arranged between a surface ring of the outer ring and a bottom of the fixing base, when the detachable installation module is moved downwards along the installation direction, the buffer elastic clip is pressed and generates an elastic deformation.

20. The assembly structure according to claim 1, wherein the lock piece further comprises a pressing portion at the other end, and by pressing the pressing portion, the lock piece is shrunk along the direction perpendicular to the sliding groove.

* * * * *